United States Patent [19]

Weinreb

[11] Patent Number: 4,887,318

[45] Date of Patent: Dec. 19, 1989

[54] SHOULDER PAD

[76] Inventor: Robert L. Weinreb, 503 Broadway, New York, N.Y. 10012

[21] Appl. No.: 319,259

[22] Filed: Mar. 3, 1989

[51] Int. Cl.[4] ..... A41D 27/26

[52] U.S. Cl. ..... 2/268; 224/264; 224/901

[58] Field of Search ..... 2/267, 268, 269; 450/86; 224/264, 901, 203, 205, 242, 257

[56] References Cited

U.S. PATENT DOCUMENTS

| | | | |
|---|---|---|---|
| 980,421 | 1/1911 | Jordan | 224/264 |
| 3,153,791 | 10/1964 | White | 2/267 |
| 4,125,904 | 11/1978 | Levine | 2/267 |
| 4,168,544 | 9/1979 | Kallman | 224/901 X |
| 4,361,258 | 11/1982 | Clark | 224/264 X |
| 4,386,723 | 6/1983 | Mule | 224/901 X |
| 4,612,935 | 9/1986 | Greifer | 2/268 X |
| 4,642,815 | 2/1987 | Allen | 2/267 X |
| 4,764,988 | 8/1988 | Reaver | 2/268 OR |
| 4,811,876 | 3/1989 | Riggi | 2/268 X |

*Primary Examiner*—Werner H. Schroeder
*Assistant Examiner*—Jeanette E. Chapman
*Attorney, Agent, or Firm*—Jacobs & Jacobs

[57] ABSTRACT

A one piece elongated shoulder pad comprised of a rubbery material for use with a shoulder strap, which comprises a base having a top, a bottom, and opposed first and second longitudinally extending sides, said first side being narrower than said second side, and at least one pair of opposed flexible cooperating tab means for retaining said shoulder strap on said pad, said tab means being integrally attached to and extending away from said base, said tab means each including cooperating fastening means for detachably fastening said tab means together, whereby said shoulder strap is retained under said tab means and on said top when said tab means are detachably fastened together.

12 Claims, 2 Drawing Sheets

FIG. 1
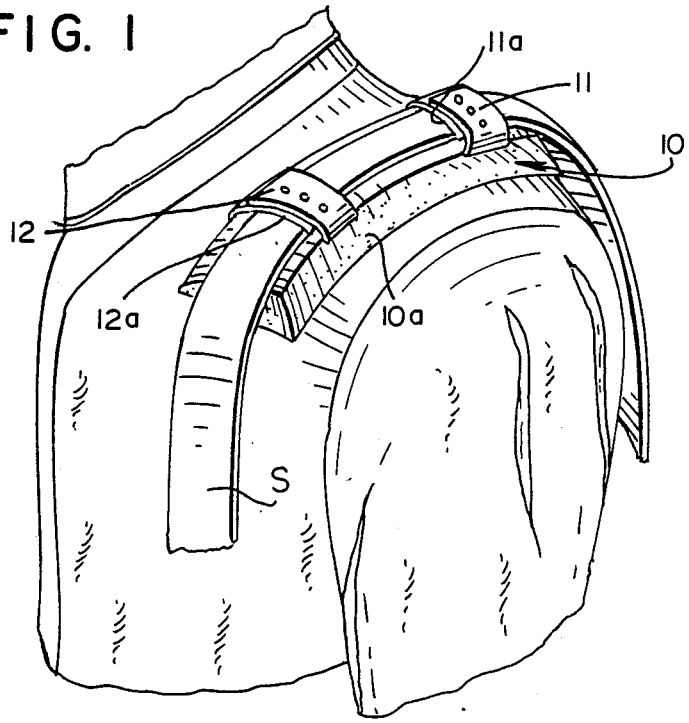
FIG. 3
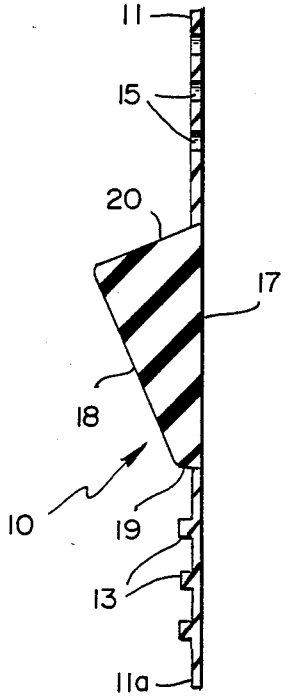
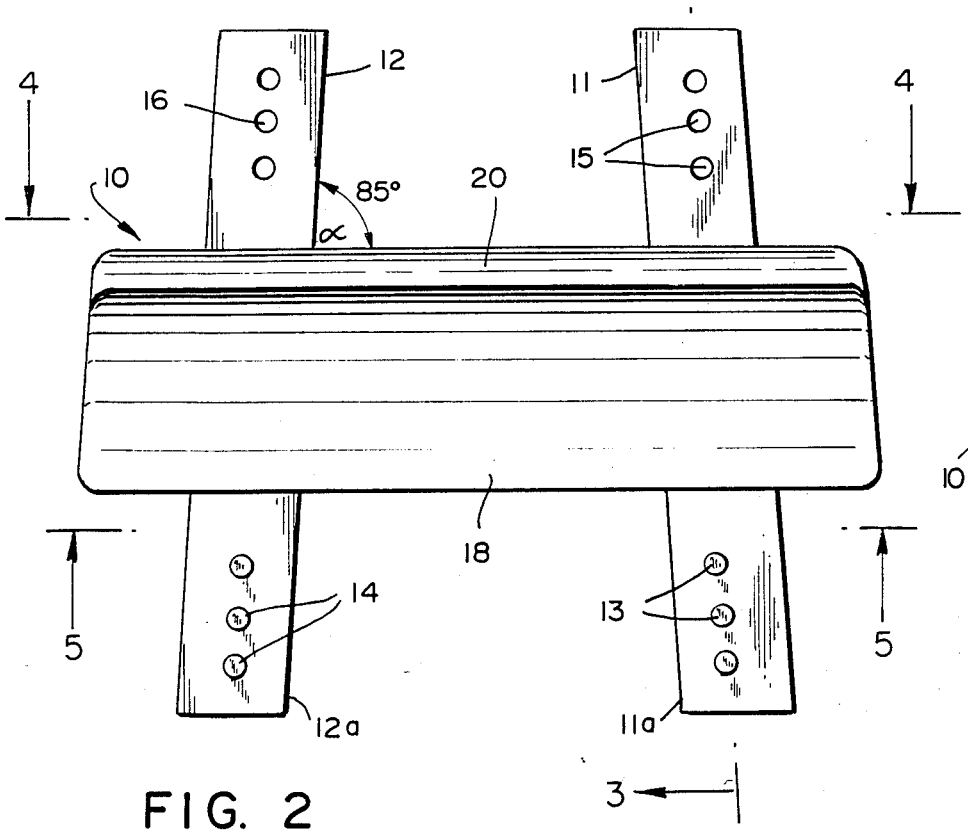
FIG. 2
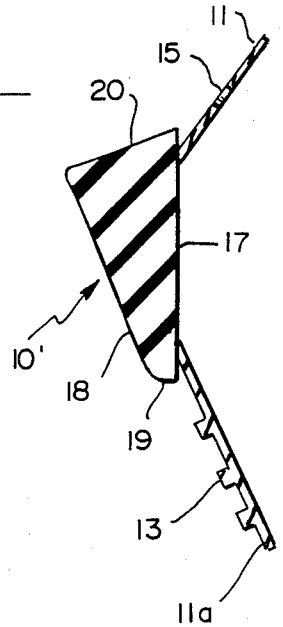
FIG. 3a

SHOULDER PAD

The present invention relates to shoulder pads for use with shoulder straps.

It is often convenient and at times necessary to carry an object by means of attaching a strap to the object and draping the strap across the shoulder. Camera equipment and accessories, luggage, and golf bags are often carried in this manner, providing the individual with at least one free arm. The postal carrier's mail bag is also transported in this manner.

The shoulder of the average person slopes downwardly from the base of the neck to the upper and outer portion of the arm. As a consequence of this anatomical feature, shoulder straps tend to slide down and off the shoulder. Increasing the weight of the object being carried multiplies the downward force applied to the strap, and increases the likelihood that the strap will slip off the shoulder.

The shoulder also slopes downwardly from its apex to the upper chest and upper back regions. In most individuals, this upper portion of the shoulder is not highly muscled. The downward force applied by shoulder straps therefore tends to "dig" the straps into the relatively uncushioned skin at the apex of the shoulder, causing discomfort.

Attempts have been made to mitigate the above described problems associated with the use of shoulder straps. For example, pads have been designed which, when attached to the shoulder strap, help cushion the downward force applied to the shoulder.

One approach has been to provide a soft, relatively flat pad having two or more parallel slits through which the shoulder strap may be inserted. Such pads having two parallel slits tend to slide back and forth on the strap. Pads having four parallel slits, while less prone to migrate along the strap than pads having two slits, are often difficult to move along the strap when desired. In one prior art embodiment, a molded plastic shoulder pad is provided with two raised loops under and through which the shoulder strap is inserted. Thus, in all the foregoing examples of prior art shoulder pads, in order to attach the pad to the strap, it is necessary to completely detach one end of the shoulder strap from the object being carried.

Many shoulder pads have been constructed of two or more materials, typically a soft lower layer (e.g. foam or cloth), and a stiffer upper layer or layers (e.g. leather or plastic). Such shoulder pads have typically been provided with two or more parallel slits through which the shoulder strap is inserted. In some embodiments, slits are provided only in the upper layer so that the shoulder strap does not contact the shoulder. Alternatively, the shoulder strap is drawn completely between the upper and lower layers.

Shoulder pads constructed of two or more materials are unsatisfactory for several reasons. Such shoulder pads, due to increased material and manufacturing costs, are expensive to manufacture. The need to permanently attach the two or more materials together, whether through lamination, gluing, or machine or hand stitching, increases production time. Furthermore, the integrity of a shoulder pad constructed of two or more materials is wholly dependent upon the strength of the bond holding the materials together. Shoulder pads which are glued, sewn, or pressed together have a marked tendency to rip or separate, especially where the shoulder strap is inserted through or between the materials comprising the pad.

Some shoulder pads have been provided with means for securing the shoulder strap to the pad so as to obviate inserting the strap through the pad or any portion thereof. Such shoulder pads, although avoiding the need to completely detach one end of the strap from the object being carried in order to affix the pad to the strap, have also been unsatisfactory. The means typically utilized to secure these shoulder pads to a shoulder strap are cooperating tabs attached to the pad which are capable of being attached to and detached from one another, thereby retaining the shoulder strap underneath. These tabs, which are made from materials different than the pad, may be attached to one another by means of buckles, loops, Velcro brand fasteners or other detachable fastening means.

These shoulder pads are also unsatisfactory because they, too, require several different materials to construct the pad and are thus not efficiently assembled. In one prior art embodiment, two strips carrying cooperating Velcro brand hook and eye fasteners extend outwardly from between two glued layers which comprise the pad. The Velcro fasteners are secured to the laminate pad by two metal rivets. Not only are these pads time consuming and expensive to manufacture, but the laminated pad tends to separate at the four points at which the Velcro fasteners originate from between the layers of the pad.

Attempts have also been made to mitigate the tendency of shoulder pads to slide down and off the shoulder. A wedge shaped pad has been provided which provides a more horizontal base to support the shoulder straps. The pad, however, is constructed of several materials, and is therefore expensive and inefficient to manufacture as well as being prone to the previously discussed problem of separation of the layers.

The bottom of some prior art shoulder pads have even been provided with spike-like projections that "grab" the clothing underneath the pad. These spikes, however, are closely spaced and of uniform height, which makes them slippery on smooth materials and thus unsatisfactory.

The shoulder pad of the present invention solves the above-described problems associated with prior art shoulder pads. The shoulder pad of the invention described and claimed herein is constructed of a single rubbery material and is therefore efficiently and economically manufactured and is not prone to fall apart or separate as do prior art shoulder pads. The shoulder pad of the present invention is wedge-shaped to reduce the tendency of the pad to slip off the shoulder, and has integral detachable fastening tabs to retain the shoulder strap in contact with the pad without the need to detach the strap from the object being carried. In a preferred embodiment, the shoulder pad of the present invention has shoulder-contacting projections which further prevents slippage of the pad from the shoulder, and has strap-contacting projections which reduce movement of the shoulder strap on the pad.

BRIEF DESCRIPTION OF THE DRAWINGS

The present invention is illustrated in terms of its preferred embodiments shown in the accompanying drawings, wherein:

FIG. 1 is a perspective view of the shoulder pad of the present invention, attached to a shoulder strap and worn on the shoulder above the upper arm;

FIG. 2 is a plan view of the shoulder pad in FIG. 1;

FIG. 3 is a cross-sectional view of the shoulder pad as seen in the direction of arrows 3 in FIG. 2;

FIG. 3*a* is a view similar to FIG. 3 of another embodiment of the invention;

DETAILED DESCRIPTION OF THE INVENTION

Figure 4:
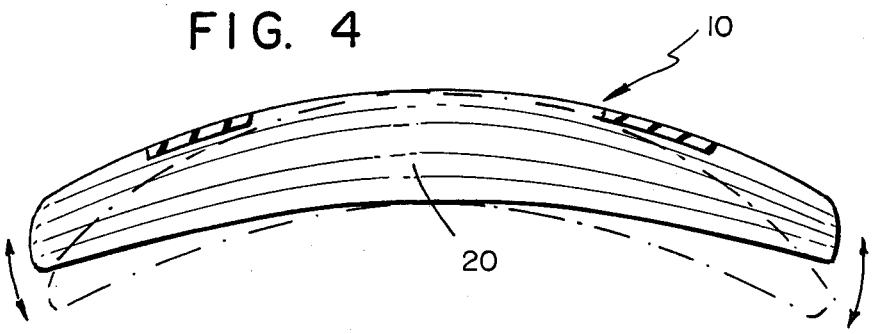
FIG. 4 is an elevational view of the shoulder pad, partly in section, as seen in the direction of arrows 4 in FIG. 2.

With reference to FIG. 1 of the drawings, pad 10 has an elongated wedge-shaped base 10*a* constructed in one piece from a rubbery material, and is provided with two pairs of integral flexible cooperating strap-retaining tabs 11, 11*a* and 12, 12*a*. The pairs of tabs 11, 11*a*, 12, 12*a*, are integrally attached to and are comprised of the same rubbery material as the base 10*a*, thus providing a shoulder pad 10 constructed of a single material. The pad 10 is shown attached to a shoulder strap and worn on the shoulder above the upper arm.

Pad 10 may be produced by any manufacturing method typically used to make objects of rubbery materials, such as injection or compression molding and casting. Injection molding has been found to be especially well suited, and is the preferred method of producing pad 10. Preferably, pad 10 is made of natural rubber, synthetic rubber, elastomers, or blends thereof. Plasticizers and fillers may be used where appropriate, as is known.

As shown in FIGS. 2 and 3, two pairs of opposed flexible tabs 11, 11*a* and 12, 12*a* extend from the opposed sides 19 and 20 of the shoulder pad 10. Tabs 11, 11*a*, 12, 12*a* are substantially coplanar with the top 17 of pad 10. It is preferred that the tabs 11, 11*a*, 12, and 12*a* extend substantially perpendicular to the longitudinal axis of the top 17, preferably forming an angle $\alpha$, of about 75° to about 95°. In an alternative embodiment, as shown in FIG. 3*a*, flexible tabs 11, 11*a*, 12, and 12*a* of pad 10' extend transversely from the top 17 of pad 10' rather than being substantially coplanar with top 17.

As further shown in FIGS. 2 and 3, tabs 11*a* and 12*a* are provided with a plurality of integral raised plugs 13 and 14 while tabs 11 and 12 are provided with cooperating apertures 15 and 16. Tabs 11 and 11*a* and 12 and 12*a* may thus be detachably fastened together when the plugs 13, 14 are forced into the respective apertures 15, 16. Apertures 15, 16 are preferably slightly smaller than the respective plugs 13, 14. The flexibility of the tabs 11, 12 enables the apertures 15, 16 to stretch, whereby plugs 13, 14 may enter and be securely retained. Tabs 11 and 11*a* and 12 and 12*a* can be detachably fastened together by other cooperating fastening means (not shown), provided the cooperating fastening means are integral with the one piece shoulder pad.

Referring again to FIG. 3, side 19 is narrower than second side 20, which provides a wedge-shape to the shoulder pad 10, whereby bottom 18 is inclined from side 20 to side 19. When the pad 10 is placed on the shoulder with first side 19 closest to the neck, top 17 provides a horizontal platform upon which a shoulder strap (FIG. 1) may be supported. This wedge shape functions to compensate for the natural slope of the shoulder from the neck to the outer and upper arm and reduces the likelihood that the shoulder strap will slip down and off the shoulder.

Figure 5:
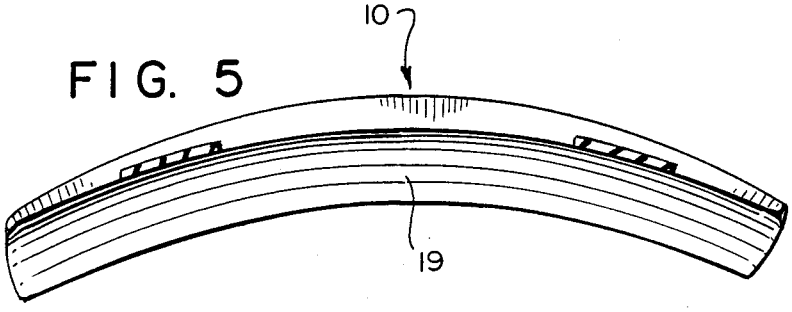
FIG. 5 is an elevational view of the shoulder pad, partly in section, as seen in the direction of arrows 5 of FIG. 2.

Pad 10 is preferably molded in an arched shape as depicted in FIGS. 4 and 5. Second side 20 is shown facing outwardly in FIG. 4, and opposing narrower first side 19 is shown facing outwardly in FIG. 5. The degree of arch provided for the shoulder pad 10 is not critical, since the pad 10 is comprised of a flexible rubbery material which can conform to the anatomy of the shoulder under the downward force of the shoulder strap attached to the object being carried, as is depicted by the broken lines of FIGS. 4 and 5.

Figure 6:
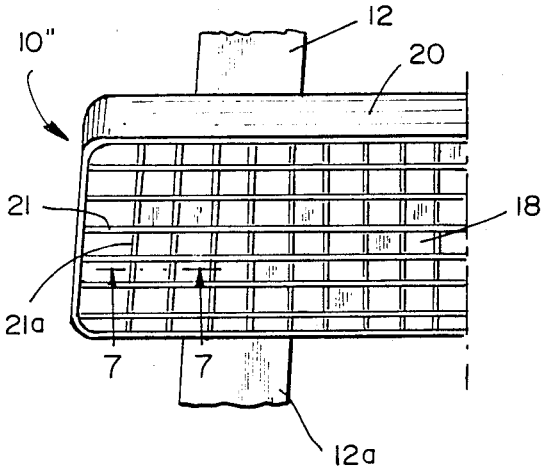
FIG. 6 is a detail view of another embodiment of the shoulder pad of the present invention, depicting shoulder-contacting projections extending perpendicularly from the bottom surface of the pad.
Figure 7:
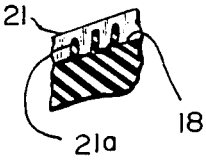
FIG. 7 is a detail view in section taken along line 7—7 of FIG. 6.

FIGS. 6 and 7 illustrate another preferred embodiment of the present invention, wherein shoulder-contacting projections 21 and 21*a* extend perpendicularly from the bottom 18 of pad 10''. Projections 21 and 21*a* are comprised of the same rubbery material as pad 10'' and tabs 11, 11*a*, 12, 12*a*. Projections 21 and 21*a* function to stabilize the shoulder pad and reduce slippage of the pad 10 from the shoulder. Projections 21 and 21*a* may be arranged in any form, but the rectilinear grid-like pattern depicted in FIG. 6 is most preferred. When such a grid-like pattern is provided, it is additionally preferred, as depicted in FIG. 7, that projections 21, which extend longitudinally, i.e., are oriented parallel to opposing sides 19 and 20, extend outwardly farther from the bottom 18 of pad 10 than projections 21*a*, which extend transversely, i.e., are oriented perpendicularly to opposing sides 19 and 20.

Figure 8:
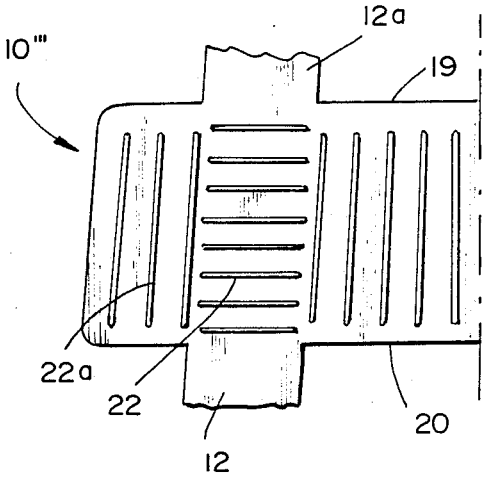
FIG. 8 is a detail view of another embodiment of the shoulder pad of the present invention, depicting strap-contacting projections extending perpendicularly from the top surface of the pad.

FIG. 8 shows another preferred embodiment of the invention, wherein strap-contacting projections 22 and 22*a* extend perpendicularly from the top 17 of pad 10'''. Projections 22 and 22*a* are comprised of the same rubbery material as pad 10''' and tabs 11, 11*a*, 12, 12*a*. Projections 22 and 22*a* reduce slippage of the shoulder strap relative to the top 17 of pad 10'''. It is, of course, possible, and indeed is preferred, to provide projections 21, 21*a*, 22, 22*a* on the top and bottom of the same pad (not shown).

I claim:

1. A one piece elongated shoulder pad comprised of a rubbery material for use with a shoulder strap, which comprises a base having a top, a bottom, and opposed first and second longitudinally extending sides, said first side being narrower than said second side, and at least one pair of opposed flexible cooperating tab means for retaining said shoulder strap on said pad, said tab means being integrally attached to and extending away from said base, said tab means each including cooperating fastening means for detachably fastening said tab means together, whereby said shoulder strap is retained under said tab means and on said top when said tab means are detachably fastened together.

2. The shoulder pad according to claim 1, wherein the rubbery material comprising the pad is selected from the group consisting of natural rubbers, synthetic rubbers, and elastomers.

3. The shoulder pad according to claim 1, wherein said bottom of said pad has extending therefrom a plurality of shoulder-contacting projections, said projections being integral with said bottom.

4. The shoulder pad according to claim 1, wherein said top of said pad has extending therefrom a plurality of strap-contacting projections, said projections being integral with said top.

5. The shoulder pad according to claim 1, wherein one of said pair of tab means has projecting perpendicularly therefrom a plurality of integrally connected plugs and the other of said pair of tab means has corresponding apertures for receiving and retaining said plugs, whereby when said plugs are inserted in said apertures said tab means are detachably fastened together.

6. The shoulder pad according to claim 1, wherein said tab means are coplanar with said top.

7. The shoulder pad according to claim 1, wherein said tab means extend transversely from said top.

8. The shoulder pad according to claim 2, wherein said bottom of said pad has extending therefrom a plurality of shoulder-contacting projections, said projections being integral with said bottom.

9. The shoulder pad according to claim 8, wherein said top of said pad has extending therefrom a plurality of strap-contacting projections, said projections being integral with said top.

10. The shoulder pad according to claim 9, wherein one of said pair of tab means has projecting perpendicularly therefrom a plurality of integrally connected plugs and the other of said pair of tab means has corresponding apertures for receiving and retaining said plugs, whereby when said plugs are inserted in said apertures said tab means are detachably fastened together.

11. The shoulder pad according to claim 10, wherein said tab means are coplanar with said top.

12. The shoulder pad according to claim 10, wherein said tab means extend transversely from said top.

* * * * *